US005102859A

United States Patent [19]

Kanto et al.

[11] Patent Number: 5,102,859

[45] Date of Patent: Apr. 7, 1992

[54] HEAT TRANSFER SHEET

[75] Inventors: Jumpei Kanto; Masayuki Nakamura, both of Tokyo, Japan

[73] Assignee: Dai Nippon Insatsu Kabushiki Kaisha, Japan

[21] Appl. No.: 604,296

[22] Filed: Oct. 26, 1990

[30] Foreign Application Priority Data

Oct. 31, 1989 [JP] Japan ..... 1-281656

[51] Int. Cl.[5] ..... B41M 5/035; B41M 5/26

[52] U.S. Cl. ..... 503/227; 428/195; 428/913; 428/914

[58] Field of Search ..... 8/471; 428/195, 913, 428/914; 503/227

[56] References Cited

FOREIGN PATENT DOCUMENTS 0279467 8/1988 European Pat. Off. ..... 503/227

*Primary Examiner*—Bruce H. Hess

*Attorney, Agent, or Firm*—Parkhurst, Wendel & Rossi

[57] ABSTRACT

A heat transfer sheet comprising a substrate sheet and a dye carrier layer formed on its one major side, characterized in that a dye included in said dye carrier layer is expressed by the following general formula (I):

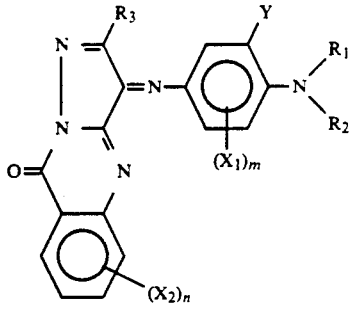

(I)

wherein:

$R_1$ stands for a substituted or unsubstituted alkyl, cycloalkyl, aralkyl or aryl group, or an atom or atomic gorup which forms a five- or six-membered ring with Y, $R_2$ denotes a substituted or unsubstituted alkyl, cycloalkyl, aralkyl or aryl group, said $R_1$ and $R_2$ may form together a five- or six-membered ring which may include an oxygen, nitrogen or sulfur atom, $R_3$ represents a hydrogen atom, a halogen atom or a cyano group, or an alkyl, cycloalkyl, aryl, aralkyl, alkoxy, alkylthio, aryloxy, arylthio, acylamino, sulfonylamino, ureido, carbamoyl, sulfamoyl, acyl or amino group which may contain a substituent, $X_1$ represents a hydrogen atom, a halogen atom or a cyano group, or an alkyl, cycloalkyl, alkoxy, aryl, aralkyl, acylamino, sulfonylamino, ureido, carbamoyl, sulfamoyl, acyl or amino group which may contain a substituent, .

$X_2$ represents a hydrogen atom, a halogen atom or a cyano, nitro, alkyl, alkoxy, aryl, aralkyl, acylamino, ureido, acyl or amino group, Y stands for a hydrogen atom, or an atom or atomic group which form a five- or six-membered ring with $R_1$, and m and n each are 1 or 2.

2 Claims, No Drawings

HEAT TRANSFER SHEET

BACKGROUND OF THE INVENTION

The present invention relates to a heat transfer sheet and, more particularly, to a heat transfer sheet capable of recording an image representation excelling in the density of developed colors, clearness and various fastness properties, esp., storability.

Heretofore, various heat transfer techniques have been known in the art, including sublimation type transfer systems wherein a sublimable dye is carried on a substrate sheet such as paper to make a heat transfer sheet, which is then overlaid on an imageable or image-receiving material dyeable with a sublimable dye, for instance, a woven fabric made of polyester to apply heat energy in the form of a pattern from the back side of the heat transfer sheet, thereby transferring the sublimable dye onto the image-receiving material.

More recently, there have been proposed techniques for making various full-color images on paper or plastic films with the above sublimation type of heat transfer systems, in which thermal heads of printers are used as heating means to transfer three-, four- or more-color dots to image-receiving materials by quick heating, thereby reproducing or reconstructing full-color images of manuscripts with said multicolor dots.

Because of the coloring materials used being dyes, the thus formed image representations are very clear and because of being excellent in transparency, the obtained image representations are improved in the reproducibility and gradation or gray scale of neutral tints, are equivalent to those achieved by conventional offset or gravure printing, and are comparable in quality to full-color photographic images.

However, the most important problems with the above heat transfer systems are the color density, storability and resistance to discoloration/fading of the formed image representations.

In fast recording, heat energy is required to be applied within a time as short as fractions of a second. However, no image representations of sufficient color density can be obtained at all, since sublimable dyes and image-receiving materials are not well-heated within such short a time.

In order to cope with such fast recording, sublimable dyes excelling in sublimability have been developed. However, problems with such dyes of excellent sublimability are that after transfer, they migrate onto the image-receiving materials or bleed through with time, generally because of their low molecular weight. In consequence, the image representations become disfigured or blurred, or otherwise contaminate surrounding articles.

Even when a sublimable dye having a relatively high molecular weight is used to avoid such problems, no image representation of satisfactory color density can be obtained whatsoever, since its rate of sublimation is too slow for such fast recording as mentioned above

SUMMARY OF THE INVENTION

A main object of the present invention is therefore to provide a heat transfer sheet capable of being effectively used with a heat transfer process using a sublimable dye to make a clear image representation, which is not only of sufficient color density but also excels in various fastness properties, esp., storability.

The above object is attained by the present invention to be described in greater detail.

According to the present invention, there is provided a heat transfer sheet comprising a substrate sheet and a dye carrier layer formed on its one major side, characterized in that a dye included in said dye carrier layer is expressed by the following general formula (I):

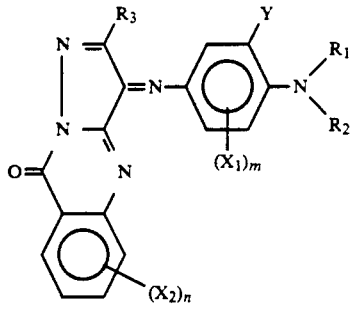

(I)

wherein:

$R_1$ stands for a substituted or unsubstituted alkyl, cycloalkyl, aralkyl or aryl group, or an atom or atomic group which forms a five- or six-membered ring with Y, $R_2$ denotes a substituted or unsubstituted alkyl, cycloalkyl, aralkyl or aryl group, said $R_1$ and $R_2$ may form together a five- or six-membered ring which may include an oxygen, nitrogen or sulfur atom, $R_3$ represents a hydrogen atom, a halogen atom or a cyano group, or an alkyl, cycloalkyl, aryl, aralkyl, alkoxy, alkylthio, aryloxy, arylthio, acylamino, sulfonylamino, ureido, carbamoyl, sulfamoyl, acyl or amino group which may contain a substituent, $X_1$ represents a hydrogen atom, a halogen atom or a cyano group, or an alkyl, cycloalkyl, alkoxy, aryl, aralkyl, acylamino, sulfonylamino, ureido, carbamoyl, sulfamoyl, acyl or amino group which may contain a substituent, $X_2$ represents a hydrogen atom, a halogen atom or a cyano, nitro, alkyl, alkoxy, aryl, aralkyl, acylamino, ureido, carbamoyl, acyl or amino group, Y stands for a hydrogen atom, or an atom or atomic group which form a five- or six-membered ring with $R_1$, and m and n each are 1 or 2.

By using the dye of a specific structure, it is possible to provide a heat transfer sheet in which the dye is permitted to migrate easily onto an image-receiving material even by very short-time exposure to heat energy, thereby giving a image representation which possesses high color density and is improved in various fastness properties, esp., storability.

DETAILED DESCRIPTION OF THE INVENTION

The present invention will now be explained in greater detail with reference to its preferred embodiments.

The dyes used in this invention and represented by Formula (I) may be easily prepared by any one of processes so far known in the art, e.g., by the dehydrating reaction of a pyrazoloquinone derivative represented by the following general formula (a) with a nitroso compound represented by the following general formula (b) in the presence of an acid or base.

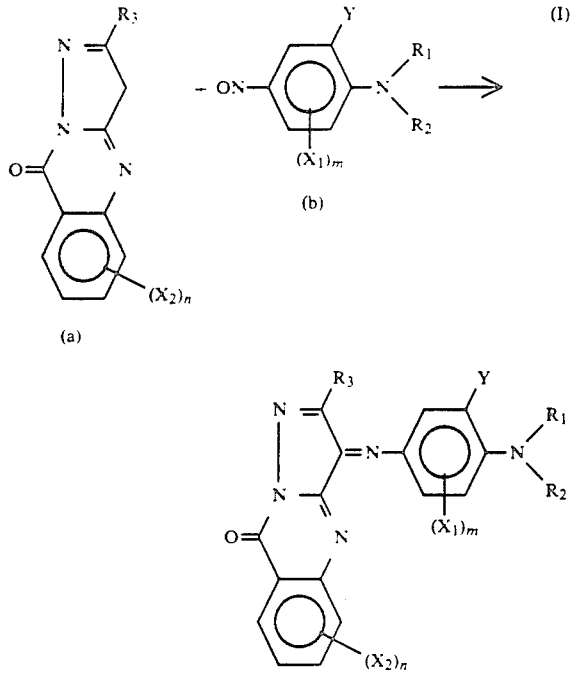

(I)

(a) (b)

wherein $R_1$ to $R_3$, $X_1$ and $X_2$, Y, m and n have the same meanings as defined above.

The pyrazoloquinone derivatives of Formula (a) may be easily synthesized by such processes as described in, e.g., Japanese Patent Laid-Open Publication (Kokai) No. 64(1989)-71878.

Set below are preferable examples of the substituents expressed in terms of $R_1$ to $R_3$ and $X_1$ and $X_2$ in Formula (I). For the alkyl group mentioned is made of methyl, ethyl, propyl and butyl groups; for the alkoxyalkyl group methoxyethyl and ethoxyethyl groups; for the hydroxyalkyl group hydroxyethyl and β-hydroxypropyl groups; for the halogenoalkyl group a chloroethyl group; for the cyanoalkyl group cyanomethyl and cyanoethyl groups; for the cycloalkyl group a cyclohexane group; for the aralkyl group benzyl and phenetyl groups; for the aryl group phenyl, tolyl, halogenophenyl and alkoxylphenyl groups; for the halogen atom fluorine, chlorine, bromine and iodine; for the alkoxy group methoxy, ethoxy, propoxy and butoxy; for the acylamino group acetylamino and benzoylamino groups; for the sulfonylamino group methanesulfonylamino, ethanesulfonylamino and benzenesulfonylamino groups; for the ureido group methylureido, 1,3-methylureido and ethylureido groups; for the carbamoyl group methylcarbamoyl, ethylcarbamoyl and phenylcarbamoyl groups; for the sulfamoyl group methylsulfamoyl, ethylsulfamoyl and phenylsulfamoyl groups; for the acyl group acetyl, propanoyl and benzoyl groups; for the amino group methylamino, ethylamino, propylamino, dimethylamino and diethylamino groups; for the alkylthio group methylthio, ethylthio and propylthio groups; for the aryloxy group phenoxy and p-methylphenoxy; and for the arylthio group phenylthio and p tolylthio groups.

Preferably, the dyes used in this invention have a molecular weight in the range of 300 to 600.

Illustrative examples of the dyes preferably used in this invention are tabulated in Table 1, wherein the substituents $R_1$ to $R_3$, $X_1$ and $X_2$, m and n in Formula (I) as well as the molecular weights of the dyes are shown, and Y is a hydrogen atom.

It is noted that $X_2$ may be located, as shown by Formula (I).

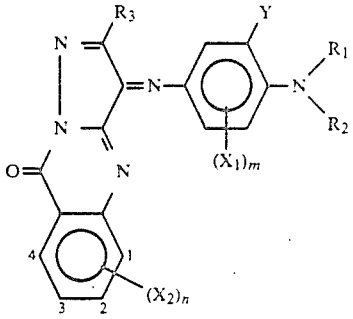

(I)

TABLE 1

| No | $R_1$ | $R_2$ | $R_3$ | $X_1$ | m | $X_2$ (position) | n | M.W. |
|---|---|---|---|---|---|---|---|---|
| 1 | $-C_2H_5$ | $-C_2H_5$ | $-CH_3$ | $-CH_3$ | 1 | —H | 1 | 373.0 |
| 2 | $-C_2H_5$ | $-CH_2Ph$ | $-CH_3$ | $-CH_3$ | 1 | —H | 1 | 435.0 |
| 3 | $-C_2H_5$ | $-C_2H_4OH$ | —Ph | $-CH_3$ | 1 | —H | 1 | 451.0 |
| 4 | $-C_2H_5$ | $-C_2H_4CN$ | $-CH_3$ | $-CH_3$ | 1 | —H | 1 | 398.0 |
| 5 | $-C_2H_5$ | $-C_2H_4NHSO_2CH_3$ | $-OCH_3$ | $-CH_3$ | 1 | —H | 1 | 482.0 |
| 6 | $-C_2H_5$ | $-C_2H_5$ | -t-$C_4H_9$ | —H | 1 | —H | 1 | 401.0 |
| 7 | $-C_2H_5$ | $-C_2H_5$ | $-NHCOCH_3$ | $-CH_3$ | 1 | —CN (1) | 1 | 441.0 |
| 8 | $-C_2H_5$ | $-C_2H_5$ | $-CH_3$ | $-CH_3$ | 1 | —Cl (3) | 1 | 407.5 |
| 9 | $-C_2H_5$ | —Ph | $-CH_3$ | $-CH_3$ | 1 | —H | 1 | 421.0 |
| 10 | $-C_2H_5$ | $-C_2H_5$ | $-CH_3$ | $-CH_3$ | 1 | —H | 1 | 401.0 |
| 11 | $-C_2H_5$ | $-C_2H_5$ | $-COCH_3$ | $-COH_3$ | 1 | $-NHCOCH_3$ (1) | 1 | 403.0 |
| 12 | $-C_2H_5$ | $-C_2H_5$ | $-CH_3$ | $-OCH_3$ | 1 | $-CH_3$ (2) | 1 | 403.0 |
| 13 | $-C_2H_5$ | $-C_2H_5$ | $-CH_3$ | —H | 1 | —H | 1 | 359.0 |
| 14 | $-C_2H_5$ | $-C_2H_5$ | $-CH_3$ | $-CH_3$ | 1 | $-NO_2$ (1) | 1 | 418.0 |
| 15 | $-C_2h_5$ | $-C_2H_4OH$ | —Ph | $-CH_3$ | 1 | $-COOC_2H_5$ (1) | 1 | 523.0 |
| 16 | $-C_2H_5$ | $-C_2H_5$ | $-CH_3$ | $-NHCOCH_3$ | 1 | —H | 1 | 416.0 |
| 17 | $-C_2H_5$ | $-C_2H_5$ | -t-$C_4H_9$ | $-CH_3$ | 1 | $-SO_2C_2H_5$ (1) | 1 | 507.0 |
| 18 | $-C_2H_5$ | $-C_2H_3$ | -t-$C_4H_9$ | —H | 1 | di-Cl (1, 3) | 2 | 470.0 |
| 19 | $-C_2H_5$ | $-C_2H_5$ | $-COOC_2H_5$ | $-NHCOCH_3$ | 1 | —H | 1 | 474.0 |
| 20 | $-C_2H_5$ | $-C_2H_5$ | $-CH_3$ | $-CH_3$ | 1 | $-CH_3$ (3) | 1 | 387.0 |
| 21 | $-C_2H_5$ | $-C_2H_4OH$ | $-CH_3$ | $-CH_3$ | 1 | —H | 1 | 389.0 |
| 22 | $-C_2H_5$ | $-C_2H_5$ | $-COOC_2H_5$ | $-CH_3$ | 1 | —H | 1 | 431.0 |
| 23 | $-C_2H_5$ | $-C_2H_5$ | —CN | $-OCH_3$ | 1 | —CN (1) | 1 | 425.0 |
| 24 | $-C_2H_5$ | $-C_2H_4OH$ | $-COOC_2H_5$ | $-OCH_3$ | 1 | $-CH_3$ (2) | 1 | 477.0 |

The heat transfer sheets according to the present invention are characterized by using such specific dyes as mentioned above, and may be identical in otherwise structure with conventional, known heat transfer sheets As the substrate sheet used for the heat transfer sheet containing the above dye according to this invention, use may be made of any known material having some heat resistance and strength. By way of example alone, use may be made of paper sheets, various processed-paper sheets, polyester films, polystyrene films, polypropylene films, polysulfone films, polycarbonate films, aramid films, polyvinyl alcohol films, cellophane and so on, all having a thickness of about 0.5 to 50 μm, preferably about 3 to 10 μm. Particular preference is given to polyester films.

The dye carrier layers formed on the surfaces of such substrate sheets as mentioned above may be obtained by carrying the dyes of Formula (I) thereon with any suitable binder resin.

As the binder resins to carry the above dye, use may be made of any known available resins. Preferable to this end are cellulosic resins such as ethyl cellulose, hydroxyethyl cellulose, ethylhydroxyl cellulose, hydroxypropyl cellulose, methyl cellulose, cellulose acetate and cellulose acetate butyrate; and vinylic resins such as polyvinyl alcohol, polyvinyl acetate, polyvinyl butyral, polyvinyl acetal, polyvinyl pyrrolidone and polyacrylic amide. Of these resins, particular preference is given to polyvinyl butyral and polyvinyl acetal in view of heat resistance, dye migration and other factors.

The dye carrier layers of the heat transfer sheets according to this invention are basically formed of the above materials and, if required, may include various additives such as those heretofore known in the art.

Preferably, such a dye carrier layer may be formed on the above substrate sheet by dissolving or dispersing the above dye, binder resin and any other components in a suitable solvent to prepare a coating or ink liquid for the formation of the dye carrier layer and, then, coating it on the substrate sheet, followed by drying.

Suitably, the dye carrier layer formed in this manner has a thickness of about 0.2 to 5.0 μm, preferably about 0.4 to 2.0 μm and a dye content of 5 to 70% by weight, preferably 10 to 60% by weight based on the weight thereof.

The heat transfer sheets of this invention may be successfully used as such for the purpose of heat transfer. By the provision of an anti-tack layer, i.e., a release coat on the surface of the dye carrier layer, however, it is possible to prevent the heat transfer sheet from sticking to an image-receiving material at the time of heat transfer and hence use much more increased heat transfer temperatures, thereby forming an image representation of much more improved color density.

Some anti-tack effects may be obtained by using only anti-tack inorganic powders for that release layer. However, more preferable results are obtained by forming a release layer of 0.01 to 5 μm, preferably 0.05 to 2 μm in thickness from a resin having excellent releasability such as silicone, acrylic and fluorinated polymers.

It is understood that such inorganic powders or releasable polymers as mentioned above produce sufficient release effects, even if they are contained in the dye carrier layer.

Further, such a heat transfer sheet may additionally be provided on its back side with a heat-resistant layer so as to prevent the heat of a thermal head from having an adverse influence thereon.

The image-receiving material used for forming an image representation with such a heat transfer sheet as mentioned above may be any material having its recording surface capable of receiving the above dye. In the case of paper, metal, glass, synthetic resin or the like having the property of being incapable of receiving the dye, they may be provided on one of their major surfaces with a dye receiving layer.

As the thermal energy applying means used for carrying out heat transfer with such a heat transfer sheet of this invention as already indicated and such an image-receiving material as already stated, any of conventional means hitherto known in the art may be used. For instance, the desired object is successfully achievable by the application of a heat energy of about 5 to 100 $mJ/mm^2$ for a controlled recording time with such recording hardware as a thermal printer (e.g., Video Printer VY-100 made by Hitachi Co., Ltd.).

In particular, the heat transfer sheet of this invention can form a cyan image and so can provide a full-color image representation excelling in color reproducibility by using it in combination with yellow and magenta heat transfer sheets. For the dye of the yellow heat transfer sheet used in combination with the heat transfer sheet of this invention, a yellow dye represented by the following structural formula is particularly preferred.

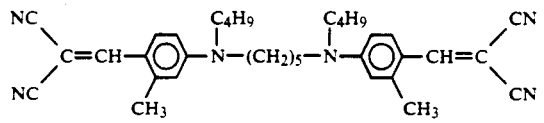

For the dye of the magenta heat transfer sheet used in combination with the heat transfer sheet of this invention, a magenta dye having the following structural formula is particularly preferred.

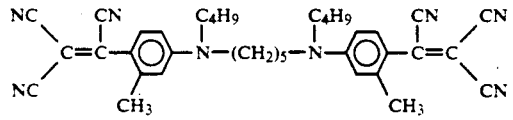

According to the present invention as detailed above, although the dye used for the heat transfer sheet of this invention is much higher in molecular weight than sublimable dyes used for conventional heat transfer sheets (having a molecular weight of about 150 to 250), yet it shows improved thermal dye migration and excellent dyeability and color developability with respect to the image-receiving material due to its specific structure and its having a substituent at a specific position. Moreover, it is unlikely to migrate or bleed through the image-receiving material after transferring.

Although formed of dyes, the obtained image representations are unlikely to suffer from serious discoloration/fading drawbacks which are caused by exposure to indoor light, or even when they are placed in albums or cases or form parts of books.

Thus, the image representation formed with the heat transfer sheet of this invention is so high its fastness properties, inter alia, its resistance to both dye migration and contamination, and so improved in its resistance to discoloration/fading that it cannot possibly be blurred or contaminate other articles, thus making it possible to solve various problems of the prior art.

The present invention will now be explained more illustratively with reference to the following reference examples, examples and comparative examples It is understood that unless otherwise stated, "parts" and "%" are given on weight basis.

REFERENCE EXAMPLE 1

Dissolved in 500 ml of methanol were 3.73 g of the pyrazoloquinone derivative expressed by the following structural formula (a) and the nitroso compound expressed by the following structural formula (b), which were then permitted to react with each other at room temperature for 3 hours, with the addition of 3.5 g of acetic anhydride After the completion of the reaction, the solution was cooled to precipitate crystals, which were filtered out. The resulting crude product was recrystallized from acetone to obtain 4.2 g of a dye shown at No. 1 in Table 1 and expressed by the following general structural formula (c) (in a yield of 72%).

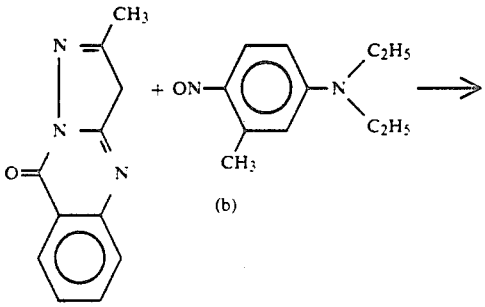

(a) (b)

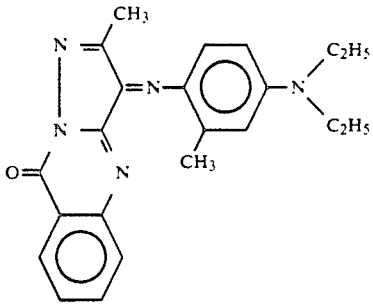

(c)

REFERENCE EXAMPLES 2-24

With the starting materials corresponding to dyes shown at Nos. 2 to 24 in Table 1, dyes Nos. 2 to 24 were obtained in the same manner as described in Reference Example 1.

EXAMPLES

Prepared was an ink composition for the formation of a dye carrier layer, composed of the following ingredients, which ws then coated on a 6-μm thick polyethylene terephthalate film subjected to heat-resistant treatment on its back side to a dry coverage of 1.0 g/m$^2$. Subsequent drying gave a heat transfer sheet according to this invention.

| | |
|---|---|
| Dyes shown in Table 1 | 3 parts |
| Polyvinyl butyral resin | 4.5 parts |
| Methyl ethyl ketone | 46.25 parts |
| Toluene | 46.25 parts |

It is noted, however, that when the dyes were insoluble in the above composition, DMP, dioxane, chloroform, etc. were optionally be sued as the solvents.

Next, a coating solution composed of the following ingredients were coated on one side of a substrate sheet formed of a synthetic paper (Yupo FPG #150 made by Oji Yuka Co., Ltd.) in an amount of 10.0 g/m$^2$ on dry basis, which was then dried at 100° C. for 30 minutes to obtain an image-receiving material.

| | |
|---|---|
| Polyester resin (Vylon 200 made by Toyobo Co., Ltd.) | 11.5 parts |
| Vinyl chloride/vinyl acetate copolymer (VYHH made by UCC) | 5.0 parts |
| Amino modified silicone (KF-393 made by the Shin-Etsu Chemical Co., Ltd.) | 1.2 parts |
| Epoxy modified silicone (X-22-343 made by the Shin-Etsu Chemical Co., Ltd.) | 1.2 parts |
| Methyl ethyl ketone/toluene/cyclohexanone (4:4:2 in weight ratio) | 102.0 parts |

Each of the above heat transfer sheets according to this invention was overlaid on the above image-receiving material with the dye carrier layer and the dye-receiving surface located in opposition to each other. Then, recording was carried out from the back side of the heat transfer sheet with a thermal head under the following conditions: at a voltage of 10 V applied to the head for a printing time of 4.0 msec. The results are reported in Table 2.

TABLE 2

| Dye | Color Density | Storability | Color Tone |
|---|---|---|---|
| 1 | 1.60 | ⊙ | Blue |
| 2 | 1.56 | ⊙ | Blue |
| 3 | 1.51 | ⊙ | Blue |
| 4 | 1.55 | ⊙ | Blue |
| 5 | 1.49 | ⊙ | Blue |
| 6 | 1.59 | ⊙ | Blue |
| 7 | 1.72 | ⊙ | Blue |
| 8 | 1.55 | ⊙ | Blue |
| 9 | 1.65 | ⊙ | Blue |
| 10 | 1.54 | ⊙ | Blue |
| 11 | 1.71 | ⊙ | Blue |
| 12 | 1.60 | ⊙ | Blue |
| 13 | 1.61 | ⊙ | Blue |
| 14 | 1.39 | ⊙ | Blue |
| 15 | 1.48 | ⊙ | Blue |
| 16 | 1.66 | ⊙ | Blue |
| 17 | 1.78 | ⊙ | Blue |
| 18 | 1.66 | ⊙ | Blue |
| 19 | 1.67 | ⊙ | Blue |
| 20 | 1.63 | ⊙ | Blue |
| 21 | 1.37 | ⊙ | Blue |
| 22 | 1.69 | ⊙ | Blue |
| 23 | 1.64 | ⊙ | Blue |
| 24 | 1.47 | ⊙ | Blue |

COMPARATIVE EXAMPLES 1 to 5

Example 1 was repeated, provided that the dyes specified in the following Table 3 were used in place of the dyes used therein. The results are reported in Table 3.

TABLE 3

| Comp. Ex. | Color Density | Storability |
|---|---|---|
| 1 | 0.99 | X |
| 2 | 1.16 | Δ |
| 3 | 2.07 | X |
| 4 | 1.12 | Δ |

TABLE 3-continued

| Comp. Ex. | Color Density | Storability |
|---|---|---|
| 5 | 1.02 | X |

Comp. Ex 1 = C.I. Disperse Blue 14

2 = C.I. Disperse Blue 134

3 = C.I. Solvent Blue 63

4 = C.I. Disperse Blue 26

5 = C.I. Disperse Violet 4

It is noted that the color density as referred to above was measured with Densitometer RD-918 made by Macbeth Co. Ltd., U.S.A.

Storability was measured after the image representations had been allowed to stand in an atmosphere of 70° C. for 48 hours, and was estimated as follows.

Double circles indicate that the sharpness of the images underwent no change at all and that when they were rubbed with water paper, it was not colored at all; circles that the images lost sharpness with slight coloration of white paper; triangles that the images lost sharpness with white paper being colored; and crosses that the image became blurred with noticeable coloration of white paper.

What is claimed is:

1. A heat transfer sheet comprising:

a substrate sheet; and a dye carrier layer formed on the substrate;

a dye included in said dye carrier layer comprising a compound expressed by the following general formula (I):

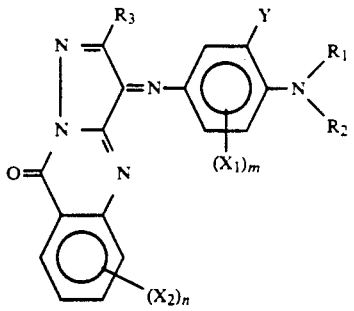

(I)

wherein:

$R_1$ stands for a substituted or unsubstituted alkyl, cycloalkyl, aralkyl or aryl group, or an atom or atomic group which forms a five- or six-membered ring with Y, $R_2$ denotes a substituted or unsubstituted alkyl, cycloalkyl, aralkyl or aryl group, said $R_1$ and $R_2$ may form together a five- or six-membered ring which may include an oxygen, nitrogen or sulfur atom, $R_3$ represents a hydrogen atom, a halogen atom or a cyano group, or an alkyl, cycloalkyl, aryl, aralkyl, alkoxy, alkylthio, aryloxy, arylthio, acylamino, sulfonylamino, ureido, carbamoyl, sulfamoyl, acyl or amino group which may contain a substituent, $X_1$ represents a hydrogen atom, a halogen atom or a cyano group, or an alkyl, cycloalkyl, alkoxy, aryl, aralkyl, acylamino, sulfonylamino, ureido, carbamoyl, sulfamoyl, acyl or amino group which may contain a substituent, $X_2$ represents a hydrogen atom, a halogen atom or a cyano, nitro, alkyl, alkoxy, aryl, aralkyl, acylamino, ureido, acyl or amino group, Y stands for a hydrogen atom, or an atom or atomic group which form a five- or six-membered ring with $R_1$, and m and n each are 1 or 2.

2. A heat transfer sheet as claimed in claim 1, wherein the dye has a molecular weight in the range of 300 to 600.

* * * * *